US010221623B2

(12) United States Patent
Derk, Jr. et al.

(10) Patent No.: US 10,221,623 B2
(45) Date of Patent: Mar. 5, 2019

(54) SHADE MOTOR WITH POWER SUPPLIED BY BRACKETS

(71) Applicant: Crestron Electronics, Inc., Rockleigh, NJ (US)

(72) Inventors: Charles R. Derk, Jr., Park Ridge, NJ (US); Benjamin Slivka, Hillsdale, NJ (US); Michael Campagna, Woodcliff, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 189 days.

(21) Appl. No.: 15/299,621

(22) Filed: Oct. 21, 2016

(65) Prior Publication Data

US 2018/0112463 A1 Apr. 26, 2018

(51) Int. Cl.

| | |
|---|---|
| ***E06B 9/44*** | (2006.01) |
| ***E06B 9/72*** | (2006.01) |
| ***A47H 1/13*** | (2006.01) |
| *E06B 9/68* | (2006.01) |
| *A47H 5/14* | (2006.01) |

(52) U.S. Cl.

CPC ..... *E06B 9/72* (2013.01); *A47H 1/13* (2013.01); *E06B 9/44* (2013.01); *A47H 5/14* (2013.01); *E06B 2009/6809* (2013.01)

(58) Field of Classification Search

CPC ..... E06B 9/44; E06B 9/48; E06B 9/50; E06B 9/72; A47H 1/13; A47H 5/14

USPC ..... 160/310, 323.1, 368.1, 903; 198/788; 248/252, 266, 268

See application file for complete search history.

(56) References Cited

U.S. PATENT DOCUMENTS

| | | | | |
|---|---|---|---|---|
| 4,045,123 | A * | 8/1977 | Brown | G03B 21/58 160/310 |
| 4,974,131 | A * | 11/1990 | Paradiso | F21V 19/008 362/217.05 |
| 5,848,634 | A * | 12/1998 | Will | E06B 9/174 160/310 |
| 7,682,039 | B2 * | 3/2010 | Kuo | F21V 21/005 362/219 |
| 7,723,939 | B2 * | 5/2010 | Carmen, Jr. | H02K 11/022 318/16 |
| 8,006,829 | B2 * | 8/2011 | Itoh | B65G 23/08 198/788 |

(Continued)

FOREIGN PATENT DOCUMENTS

| | | | |
|---|---|---|---|
| EP | 2476812 | A2 * | 7/2012 |
| JP | 06048548 | A * | 2/1994 |

*Primary Examiner* — Robert Canfield

(74) *Attorney, Agent, or Firm* — Crestron Electronics, Inc.

(57) ABSTRACT

A shade motor power bracket assembly for a shade system is provided comprising a first electrical and mounting interface adapted to provide electrical power to a shade motor and to provide a quick connect-disconnect mounting surface for a shade system that comprises the shade motor, and wherein the first electrical and mounting interface comprises a first bracket adapted to be mounted on a mounting surface and that comprises a plurality of first electrical contacts, and a shade end cap adapted to enclose a first end of a shade tube, the shade motor disposed within the shade tube, the shade end cap comprising a plurality of second electrical contacts adapted to electrically interface with respective ones of the plurality of first electrical contacts.

21 Claims, 7 Drawing Sheets

(56) References Cited

U.S. PATENT DOCUMENTS

| | | | | |
|---|---|---|---|---|
| 9,054,475 | B2 * | 6/2015 | Hoffman | H01R 33/0845 |
| 2004/0129849 | A1 * | 7/2004 | Walker | E06B 9/174<br>248/266 |
| 2007/0066112 | A1 * | 3/2007 | Tufano | H01R 4/4818<br>439/239 |
| 2010/0059341 | A1 * | 3/2010 | Itoh | B65G 23/08<br>198/788 |
| 2013/0199735 | A1 * | 8/2013 | Colson | E06B 9/42<br>160/2 |
| 2014/0224437 | A1 * | 8/2014 | Colson | E06B 9/42<br>160/291 |
| 2014/0260443 | A1 * | 9/2014 | Grziwok | E05B 65/00<br>70/62 |
| 2014/0262077 | A1 * | 9/2014 | Watkins | E06B 9/68<br>160/310 |
| 2015/0008801 | A1 * | 1/2015 | Schadlich | E06B 9/72<br>310/68 B |
| 2015/0083351 | A1 * | 3/2015 | Campagna | E06B 9/50<br>160/310 |
| 2015/0362896 | A1 * | 12/2015 | Feldstein | G05B 11/01<br>700/275 |

* cited by examiner

SHADE MOTOR WITH POWER SUPPLIED BY BRACKETS

BACKGROUND

Technical Field

Aspects of the embodiments described herein relate generally to an integrated home automation system, and more specifically to systems, methods, and modes for providing power through cables in a concealed manner to motorized shades in a residential home.

Background Art

As those of skill in the art can no doubt appreciate, the installation of motorized window treatments for use with a sophisticated home automation system can be a challenge. Trying to mount a tube with fabric attached into a small pocket or window frame is hard enough, but before the shade is hung, wire connections must be made for power and data, and then the wire must be "dressed" in such a way that it keeps the wire(s) away from the roller tube. If the wires are not dressed properly, there is a chance that the wire(s) and/or connector(s) can rub on the roller shade as it moves up and down, creating noise. Worse, the wire itself can get tangled around the tube damaging the fabric or even the shade motor itself. Further, if the insulation around the wiring is worn off, an electrical fire hazard can present itself.

Another problem is that the wire is typically hanging out of the wall or ceiling. Installers are always trying to determine the best way of concealing the wire. Oftentimes, the wire and connectors are hidden on top of the roller or behind it. While such constructive techniques can be aesthetically pleasing from the inside of the home, the wires might actually not be hidden from the outside of the home; further, the efforts to hide the wires include increased time and effort, and thus additional costs are incurred. Further still, if the shade is replaced the ad-hoc concealment of the wiring/connectors can become undone.

Still further, another problem that frequently arises is maintenance of the shades. As those of skill in the art can appreciate, from time-to-time shades will need to be cleaned and/or repaired. While typically not frequent, dust and dirt can accumulate and cause degradation of different types of materials that shades are made of, or can just plain cause the shade to become unsightly or seem "worn-out." Therefore, from time-to-time, technicians will need to take the shades down for one or more of cleaning, disassemble, and repairs to wiring or other components. Disconnecting and then reconnecting wiring can take time, and if incorrectly done can lead to further issues, and additional repairs.

Thus, there is a need to provide systems, methods, and modes for providing power, and command and data signals through cables in a concealed manner to motorized shades in a residential home.

SUMMARY

It is to be understood that both the general and detailed descriptions that follow are explanatory only and are not restrictive of the embodiments.

It is an object of the embodiments to substantially solve at least the problems and/or disadvantages discussed above, and to provide at least one or more of the advantages described below.

It is therefore a general aspect of the embodiments to provide systems, methods, and modes for providing power, and command and data signals through cables in a concealed manner to motorized shades in a residential home.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

According to a first aspect of the embodiments, a shade motor power bracket assembly for a shade system is provided, comprising: a first electrical and mounting interface adapted to provide electrical power to a shade motor and to provide a quick connect-disconnect mounting surface for a shade system that comprises the shade motor.

According to the first aspect of the embodiments, first electrical and mounting interface comprises: a first bracket adapted to be mounted on a mounting surface and that comprises a plurality of first electrical contacts; and a shade end cap adapted to enclose a first end of a shade tube, the shade motor disposed within the shade tube, the shade end cap comprising a plurality of second electrical contacts adapted to electrically interface with respective ones of the plurality of first electrical contacts.

According to the first aspect of the embodiments, the shade motor power bracket assembly further comprises: a first cable that includes wires for carrying electrical power to a shade motor and that is adapted to electrically connect to the first electrical and mounting interface via the first bracket.

According to the first aspect of the embodiments, the mounting surface comprises a window frame.

According to the first aspect of the embodiments, the quick connect-disconnect mounting surface comprises: a plurality of spring mounted plugs on the shade end cap; and a plurality of receptacles correspondingly located on the first bracket to the plurality of spring mounted plugs located on the shade end cap.

According to the first aspect of the embodiments, shade bracket further comprises: one or more antennas adapted to receive wirelessly transmitted commands, and output the received commands to a transceiver that can generate electrical signals that can operate the shade motor.

According to the first aspect of the embodiments, the shade bracket further comprises: one or more buttons adapted to generate electrical signals that can operate the shade motor.

According to the first aspect of the embodiments, the shade end cap further comprises: an antenna adapted to receive wirelessly transmitted commands, and output the received commands to a transceiver that can generate electrical signals that can operate the shade motor.

According to the first aspect of the embodiments, the shade motor power bracket assembly further comprises: a first cable adapted to provide electrical power to a shade motor and a first connector.

According to the first aspect of the embodiments, the shade motor power bracket assembly further comprises: a battery adapted to be controlled to provide operating electrical power to the shade motor.

According to the first aspect of the embodiments, the battery comprises: a rechargeable battery adapted to accept recharging current from the first electrical and mounting interface, and which is further adapted to be controlled to provide operating electrical power to the shade motor, and wherein the shade motor power bracket assembly further comprises a recharging controller circuit adapted to control the charging and discharging of the battery.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWING

Figure 1:
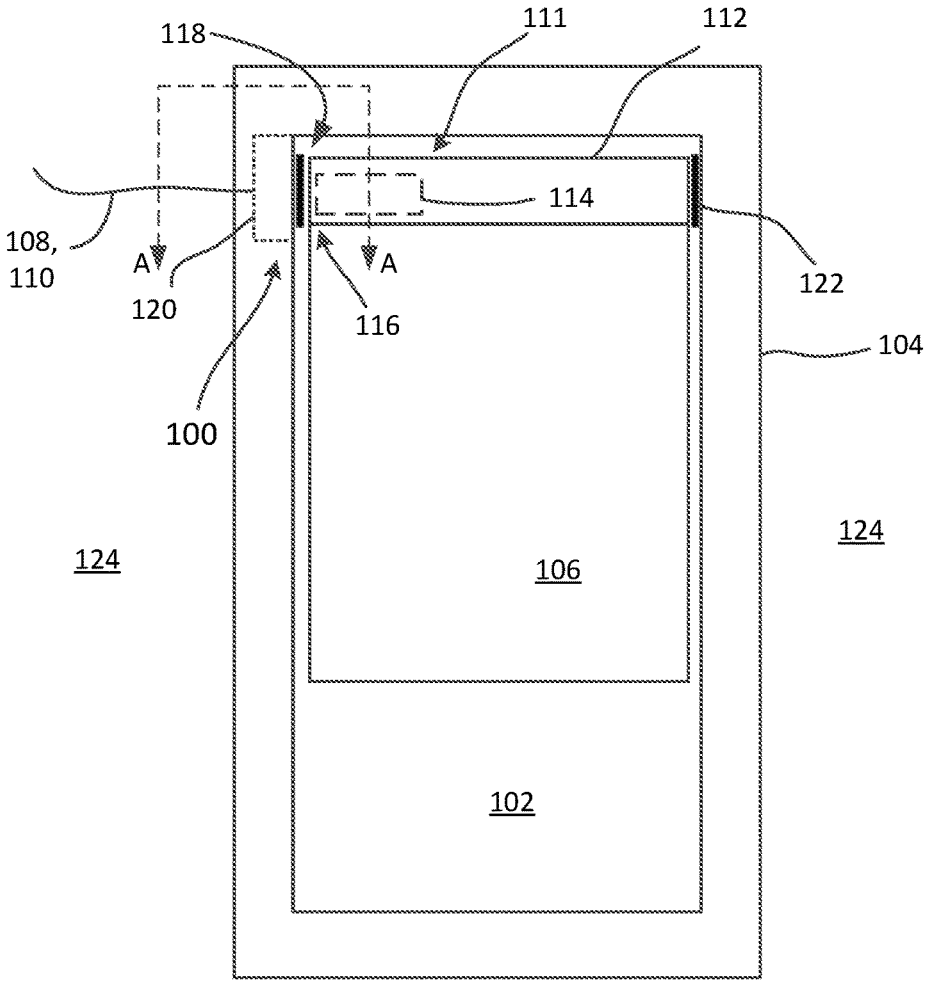

FIG. 1 illustrates a front view of an installed shade motor power bracket assembly in a window frame according to aspects of the embodiments.

Figure 2:
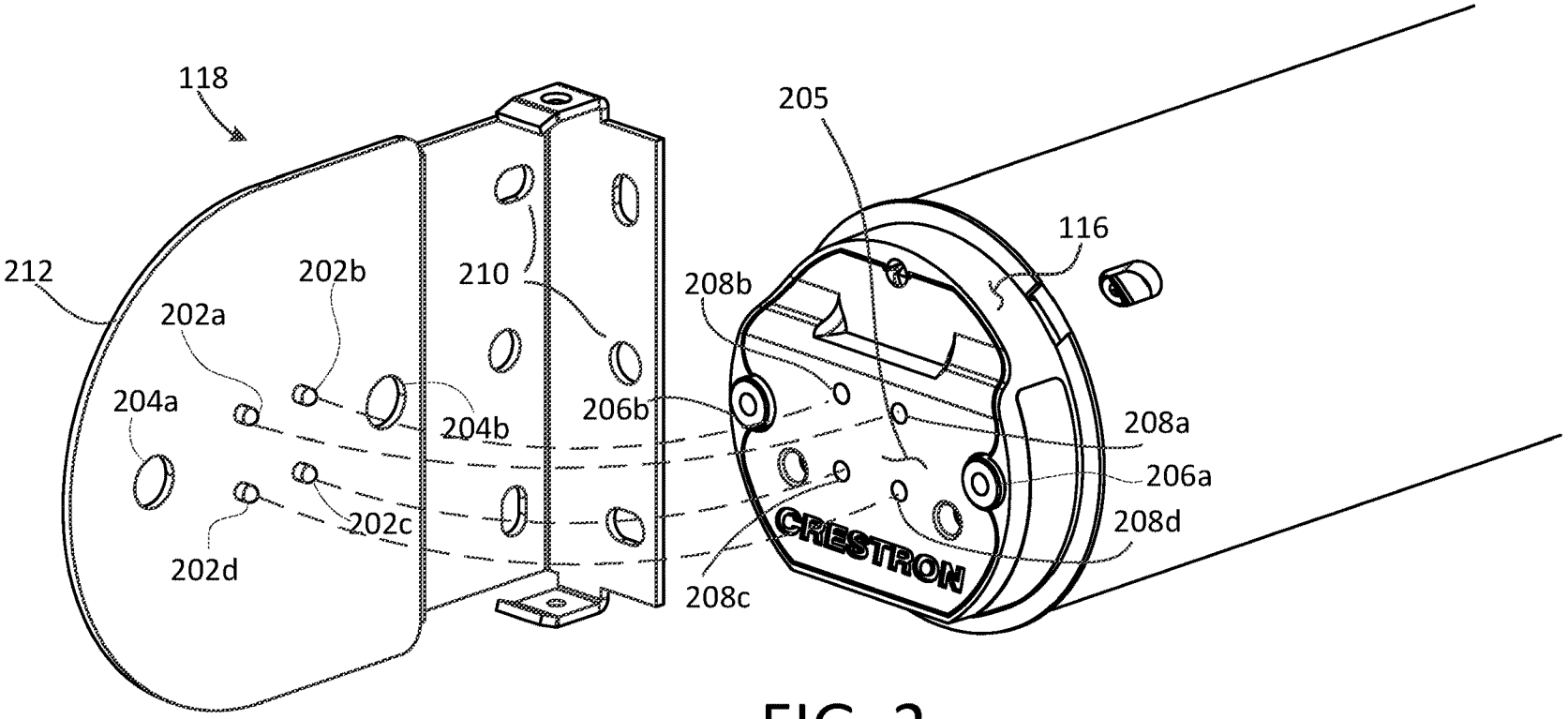

FIG. 2 illustrates a perspective view of an installation bracket with electrical contacts and a roller shade end cap/power interface with electrical contacts according to aspects of the embodiments.

Figure 3B:
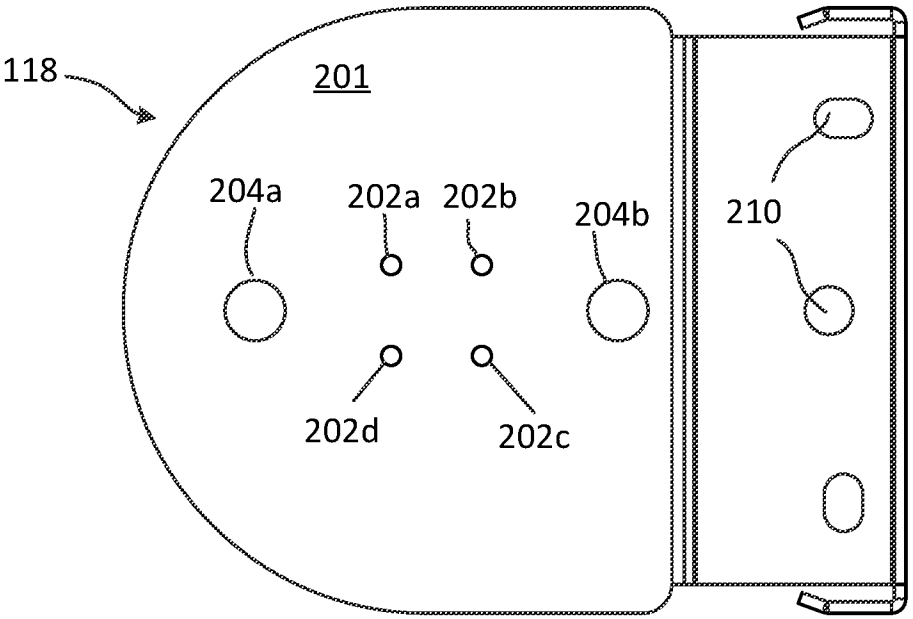
Figure 3A:
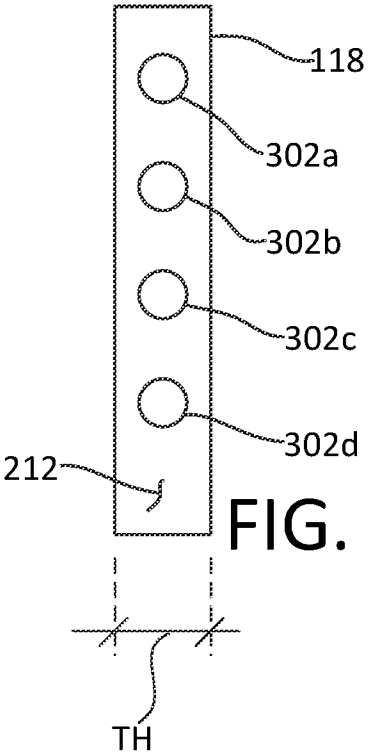

FIG. 3A illustrates a side view of the installation bracket of FIG. 2, including a plurality of buttons for controlling different aspects of operation of the shade motor according to aspects of the embodiments.

FIG. 3B illustrates a front view of the installation bracket with electrical contacts of FIG. 2 according to aspects of the embodiments.

Figure 4:
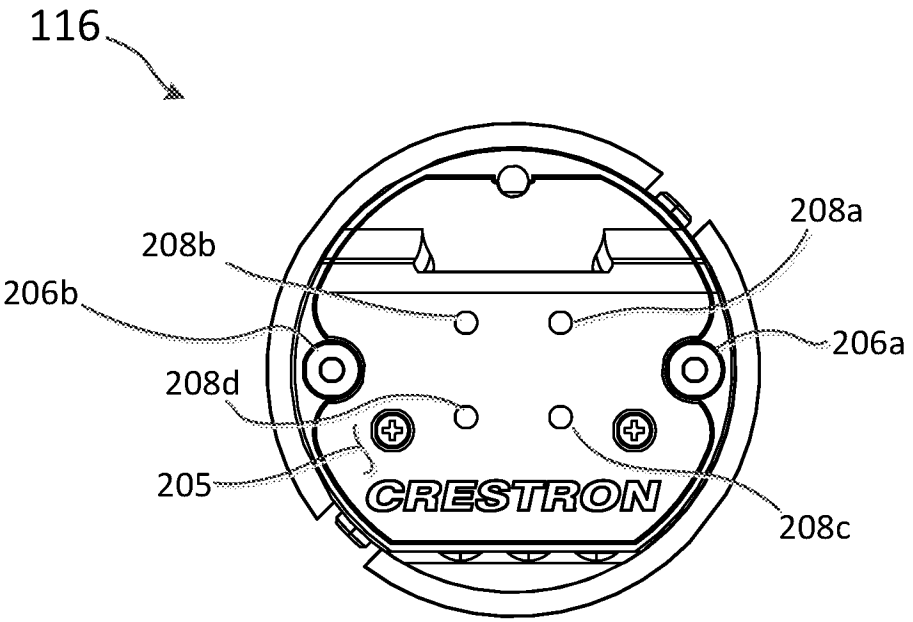

FIG. 4 illustrates a front view of the roller shade end cap/power interface with electrical contacts of FIG. 2 according to aspects of the embodiments.

Figure 5:
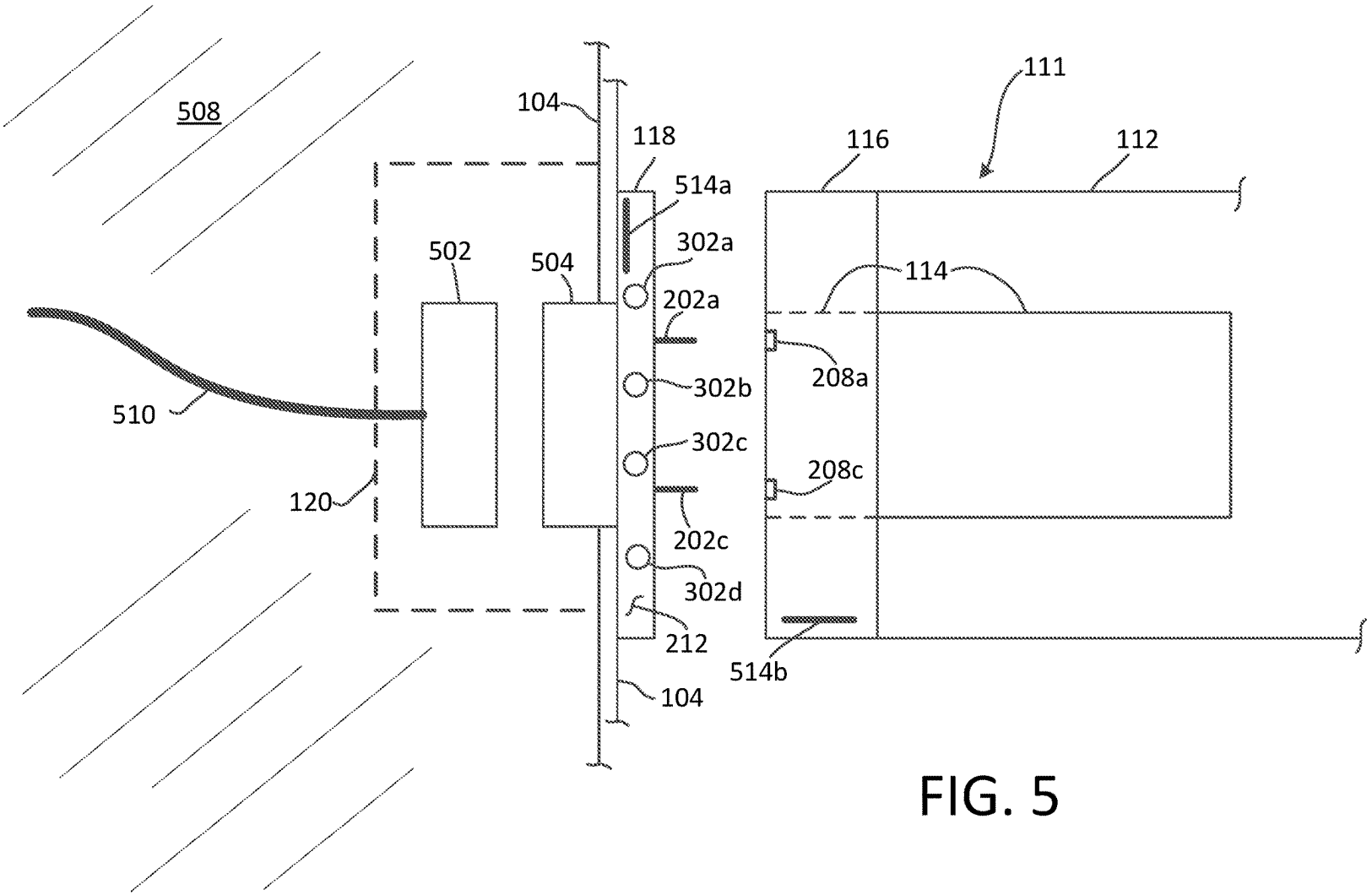

FIG. 5 illustrates a cut-away partial view of the installed roller shade along line A-A of FIG. 1 with power supplied by the electrical interconnection between the installation bracket with electrical contacts of FIG. 3 and roller shade end cap/power interface with electrical contacts of FIG. 2 according to aspects of the embodiments.

Figure 6:
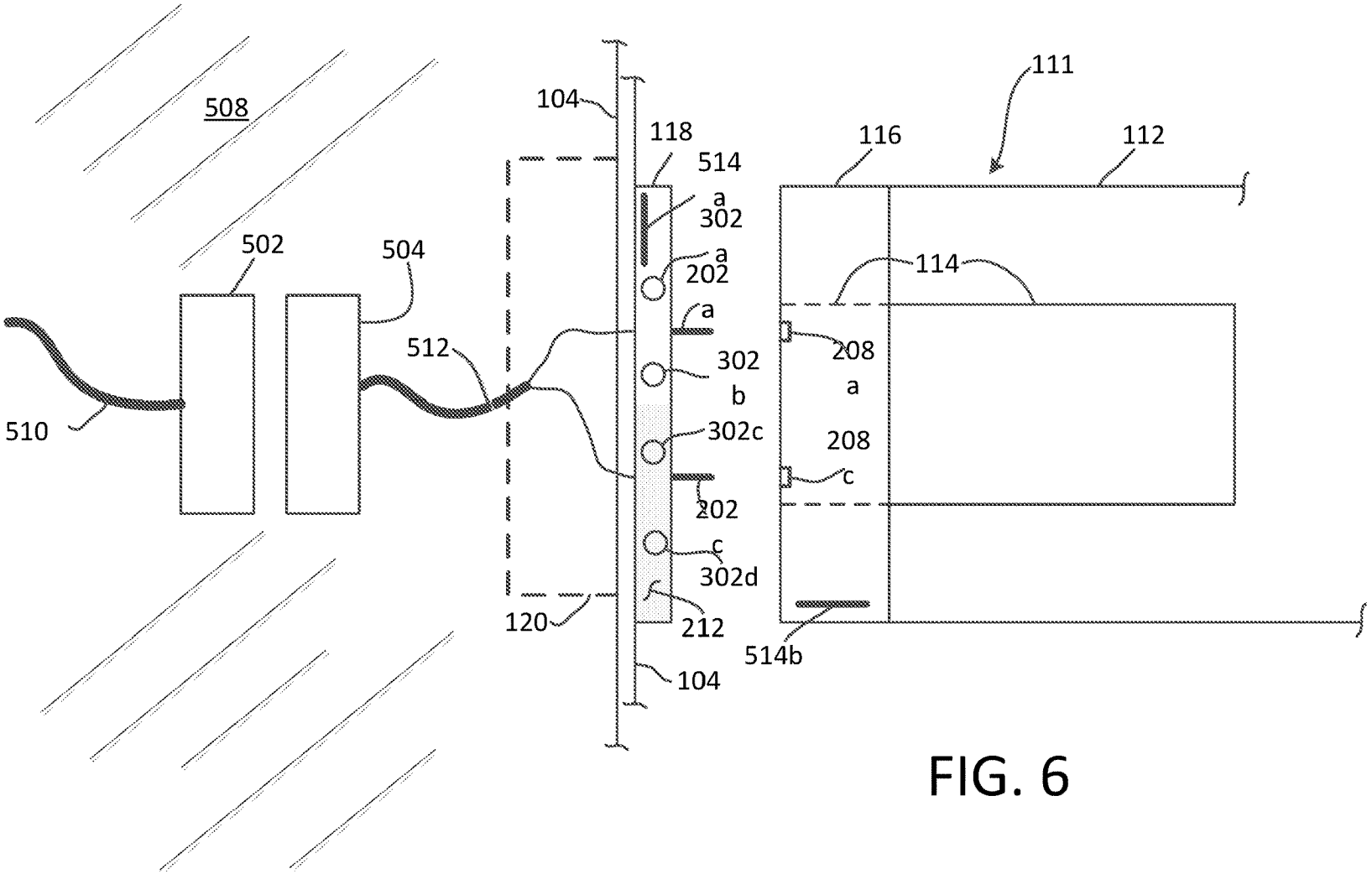

FIG. 6 illustrates a substantially similar arrangement of the installed roller shade as shown in FIG. 5 with an additional cable and respective connector according to aspects of the embodiments.

Figure 7:
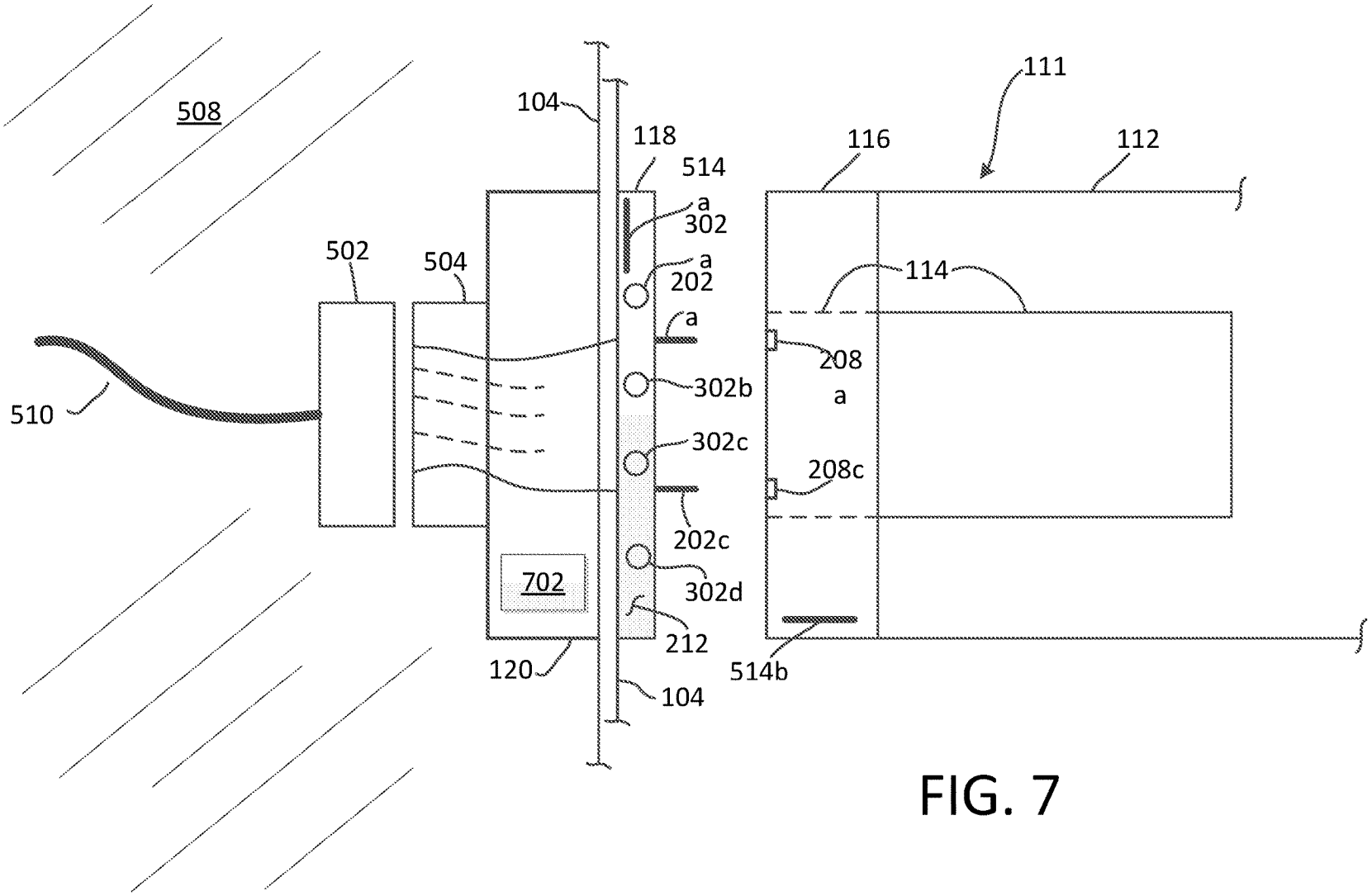

FIG. 7 illustrates a substantially similar arrangement of the installed roller shade as shown in FIGS. 5 and 6 with a different interface according to aspects of the embodiments.

DETAILED DESCRIPTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices, such as motorized roller shades.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

According to embodiments, the problems described above can be addressed by, for example, using a bracket that can be attached to a window frame and to which can be removably attached a roller shade, and which further provides an electrical interface that provides electrical power to the motor that is located within the shade tube of the window shade. The bracket that is attached to the window frame can include a connector to which is attached another connector that provides the alternating current power, as well as data and command/control signal cables.

LIST OF REFERENCE NUMBERS FOR THE ELEMENTS IN THE DRAWINGS IN NUMERICAL ORDER

The following is a list of the major elements in the drawings in numerical order.

| | |
|---|---|
| 100 | Shade Motor Power Bracket Assembly (Power Bracket Assembly) |
| 102 | Window |
| 104 | Window Frame |
| 106 | Shade |
| 108 | Shade Power Cable(s) |
| 110 | Data/Control Cable(s) |
| 111 | Shade Assembly |
| 112 | Shade Tube |
| 114 | Shade Motor |
| 116 | Roller Shade End Cap/Power Interface (Shade End Cap) |
| 118 | Installation Bracket with Electrical Contacts (First Bracket) |
| 120 | Installation Bracket Junction Box (Junction Box) |
| 122 | Installation Bracket without Electrical Contacts (Second Bracket) |
| 124 | Wall(s) |
| 201 | Front Surface Installation Bracket (Front Surface) |
| 202 | Installation Bracket Electrical Contact Pins (Pins) |
| 204 | Mounting Receptacle |
| 205 | Shade Power I/F Front Surface (Front Surface) |
| 206 | Mounting Plug (Plug) |
| 208 | Shade Power I/F Electrical Contact Receptacle (Receptacle) |
| 210 | Bracket Mounting Hole(s) |
| 212 | Side Surface of (First) Bracket |
| 302 | Control Buttons |
| 502 | Power/Data/Control Cable Plug |
| 504 | Power/Data/Control Cable Receptacle |
| 508 | Interior Wall Portion |
| 510 | First Cable (Power and/or Data and/or Command) |

-continued

| | |
|---|---|
| 512 | Second Cable |
| 514 | Antenna |
| 702 | Rechargeable Battery (Battery) |

List of Acronyms Used in the Specification in Alphabetical Order

The following is a list of the acronyms used in the specification in alphabetical order.

| | |
|---|---|
| I/F | Interface |
| VAC | Voltage Alternating Current |
| VDC | Voltage Direct Current |

Mode(s) for Carrying Out Aspects of the Embodiments

FIG. 1 illustrates a front view of installed shade motor power bracket assembly (power bracket assembly) 100 in window frame 104 according to aspects of the embodiments. The components of power bracket assembly 100 are shown in FIGS. 1-5. Referring to FIG. 1, power bracket assembly 100 includes one or more of power cables 108 (according to further aspects of the embodiments, power cable 108 need not necessarily provide 120 VAC power, but can also provide low voltage power, such as 24 VAC, among other AC voltage levels, or can provide 12 VDC power, 18 VDC, or 24 VDC, among other DC voltage levels), data command/control cable (data cable) 110, installation bracket with electrical contacts (first bracket) 118, installation bracket junction box (junction box) 120, installation bracket electrical contact pins 202 (discussed in greater detail in regard to FIG. 2), first and second connectors 502, 504 (discussed in greater detail in regard to FIG. 5), and first cable 510 (also discussed in greater detail in regard to FIG. 5). While power cable 108 can supply either an AC voltage or DC voltage, in fulfillment of the dual purposes of clarity and brevity, reference will only be made to power cable 108 as supplying electrical power, without particular regard to whether such power is provided in the form of an alternating current, or direct current, as either form can be used, according to aspects of the embodiments.

Shade assembly 111 is also shown in FIG. 1, and includes one or more of shade tube 112, shade motor 114, roller shade end cap/power interface (shade power I/F) 116, and one or more of shade power interface electrical contact receptacles (receptacles) 208 (discussed in greater detail in regard to FIG. 2). In FIG. 2 there can be seen installation bracket electrical contact pins (pins) 202, and shade power I/F electrical contact receptacles (receptacles) 208, among other components, and in FIG. 5 there can be seen power/data/control signal plug 502, and power/data/control signal receptacle 504. According to further aspects of the embodiments, shade motor 114 can receive electrical power from receptacles 208*a,b* via a motor power cable, not shown. According to still further aspects of the embodiments, a quick release mechanism can be included that enables quick release of shade tube 112 (and its parts) from first bracket 118. The quick release mechanism, according to aspects of the embodiments, can be included on one of, or both, of shade tube 112 and first bracket 118.

Referring now to FIG. 1, power bracket assembly 100 is shown on window frame 104, within wall 124. Window 102 is attached to window frame 104, and shade tube 112 is located at an uppermost position of about window 102 and window frame 104, as known to those of skill in the art. Shade tube 112 is attached to window frame 104 via first bracket 118 and installation bracket without electrical contacts (second bracket) 122. At the left end of shade tube 112 is roller shade end cap/power interface (shade power I/F) 116. Shade power I/F 116 provides an interconnection between first bracket 118 (and which is connected or attached to window frame 104 using bracket mounting holes 210) and motor 114. Also shown in FIG. 1, and which can be optionally included in the installation of power bracket assembly 100, is installation bracket junction box (junction box) 120. Junction box 120 can provide a housing for the connectors and in part the cabling that brings the electrical power and, optionally, the data/command/control signals to motor 114 and shade tube 112.

As those of skill in the art can appreciate, shade brackets are typically installed prior to hanging the actual shades. The actual shades are typically installed after all "finish-work" in a home or building is complete (to minimize shade fabric getting damaged or dirty). Previously, the wiring and interconnects would also be installed after all the "finish work" is completed. Using aspects of the embodiments, the brackets are hung and wires are terminated during the construction phase. Once the home/building is finished, shades 106 can be installed by just attaching them to first and second brackets 118,122. No wiring termination needs to be done, and no special tools are required: Consequently, little or no mess will be made.

FIG. 2 illustrates a perspective view of first bracket 118 and shade power I/F 116 according to aspects of the embodiments. First bracket 118 includes, among other components, a plurality of electrical contact pins (pins) 202*a-d*, and mounting receptacles 204*a,b*. Pins 202 can be in the form of spring-loaded pins, commonly referred to as "pogo-pins"; such pins can have a number of different lengths, diameters, shapes, and head designs (the head being the portion that makes electrical contact); further, such pogo pins can be rated for different amounts of voltage and current, and can have different size springs with different spring constants, meaning that different amounts of force are required to compress them. Mounting receptacles 204*a,b* can also be present in second bracket 122, and mounting receptacles 204 work in concert with respective mounting plugs 206 to secure shade 106 to first and second brackets 118, 122. Because first and second brackets 118, 122 are secured to window frame 104, then shade 106 will be able to be securely, but removably installed. According to aspects of the embodiments, plugs 206 can be spring loaded so that a spring force acts outwardly away from front surface 205 of shade power I/F 116, to keep plugs 206 securely within mounting receptacles 204.

In addition, pins 202*a-d* (although four are shown, there can be fewer or more pins than that as illustrated) are also spring loaded so that they are kept in a compressive fitting with shade power I/F electrical contact receptacles (receptacles) 208. The number of receptacles 208 does not necessarily need to match the number of pins 202, but a suitable number of each do need to exist in order to transfer at least power to motor 114. According to further aspects of the embodiments, shade power and data/control signals wires 110 can be connected to pins 202 and their respective signals/voltage & current carried to motor 114 through pins 202 to receptacles 208 in shade power I/F 16 and then to motor 114, or other circuitry. Further shown in FIG. 2 is side surface 212 of bracket 118. According to further aspects of the embodiments, pins 202 can be located on shade end cap 116, with receptacles 208 located on first bracket 118, as well as various combinations of receptacles 208/pins 202 being located on first bracket 118 and/or shade end cap 116.

FIG. 3A illustrates a side view of first bracket 118 of FIG. 2, including a plurality of control buttons 302 for controlling different aspects of operation of shade motor 114 according to aspects of the embodiments. For example, a first control button 302*a* can control shade motor 114 to raise shade 106, and second control button 302*b* can control shade motor 114 to lower shade 106. Further, optionally included third and fourth control buttons 302*c,d* can increase/decrease the rate of rotation of shade motor 114, or perform other functions, according to further aspects of the embodiments. Use of, and the interaction between first bracket 118, shade tube 112, and shade end cap 116 as a means for providing power to the shade motor 114 can substantially reduce the light gap between the window frame and shade 106. As those of skill in the art can appreciate, a light gap the gap between the window frame and the shade—detracts from the ability of the shade system to effectively block light. That is, even if shade 106 itself is made from the most opaque of materials but there is a substantial light gap to either or both sides of shade 106, light can penetrate the room when not desired (e.g., the shades are all the way down). However, implementation of first bracket 118, shade tube 112, and shade end cap 116 in the manner described herein to provide power to the shade motor eliminates or substantially reduces extraneous or spurious light from entering the room making the shade system more effective according to aspects of the embodiments.

FIG. 3B illustrates a front view of first bracket 118 of FIG. 2 according to aspects of the embodiments, and FIG. 4 illustrates a front view of shade power I/F 116 of FIG. 2 according to aspects of the embodiments. Mounting holes 210, which are also present in second bracket 122 are used to secure first and second brackets 118, 122 to an inner wall or surface of window frame 104.

FIG. 5 illustrates a cut-away, partial view of the installed roller shade of FIG. 1 with power supplied by the electrical interconnection between first bracket 118 and shade power I/F 116 of FIG. 2 according to aspects of the embodiments. Shown in FIG. 5 is cable 510. Cable 510 comprises either or both of shade power cable 108 and data/control cable 110 according to aspects of the embodiments, and is terminated by power/data/control plug 502. As those of skill in the art can appreciate, cable 510 can be made up of just two wires (power only, data only), or can be a plurality of wires (as many as four or six, or even more; e.g., power and data). Plug 502 mates, or interfaces with, receptacle 504; that is, receptacle 504 comprises interconnections with pins 202 in a manner know to those of skill in the art; that is, within receptacle 504 there are individual receptacles that receive pins 202 and create an electrical interface between the wires in cable 510 that are connected to pins 202 to the receptacles within receptacle 504, so that the electrical connection exists between the individual wires of cable 510 and receptacles 208 that interface with respective pins 202. Pins 202 can be spring loaded compressive pins, such as "pogo" pins, by way of a non-limiting example.

Also shown in FIG. 5 is optional installation bracket junction box (junction box) 120, which can house one or more of plug 502, and receptacle 504. As those of skill in the art can appreciate, there can be more than one cable 510, which can be connected to one or more of plugs 502, which in turn interface with respective receptacles 504. In addition, first bracket 118 can be mounted to an interior portion of window frame 104, and a hole provided therein to allow pins 202 to engage with receptacles 208.

Further shown in FIG. 5 are first and second antennas 514*a,b*; first antenna 514*a* can reside in bracket 118, and second antenna 514*b* can reside in shade end cap 116 according to aspects of the embodiments. First and second antennas 514*a,b* are also shown in FIGS. 6 and 7, although discussion is only made of the antennas in regard to FIG. 5. According to further aspects of the embodiments, some shade systems would only employ first antenna 514*a*, some would employ only second antenna 514*b*, and others might use both first and second antenna's 514*a,b*.

First and second antennas 514*a,b* can be used with a transceiver, not shown, for implementing a wireless BlueTooth communication system, IEEE 802.11.nn Wi-Fi communication system, near field communication (NFC) communication system, a cellular communication system, among others. First and second antennas 514*a,b* (there can also be three or more antennas, using different communication systems, according to further aspects of the embodiments), can be used to remotely control shade motor 114 and operation thereof of shade 106.

Attention is now directed towards FIG. 6, which illustrates a substantially similar arrangement of the installed roller shade as shown in FIG. 5 with second cable 512 according to aspects of the embodiments. According to further aspects of the embodiments, receptacle 504 can be connected to pins 202 via second cable 512 that can extend from first bracket 118, and which can then be connected to cable 510, as shown in FIG. 6. As those of skill in the art can appreciate, connectors 502, 504 can be plug and receptacle type connectors, respectively, or receptacle and plug type connectors, respectively. Junction box 120 can be used to house second cable 512 connections to pins 202.

FIG. 7 illustrates a substantially similar arrangement of the installed roller shade as shown in FIGS. 5 and 6 with a different interface according to aspects of the embodiments. In FIG. 7, there is shown connector 504 as part of, or attached to (e.g., a wall mounted or surface mounted connector) junction box 120. In addition, rechargeable battery (battery) 702 has been included as part of the assembly shown in FIG. 7. Although no interconnections have been shown, those of skill in the art can appreciate that junction box 120 would include recharging circuitry for battery 702, which would be connected to the electrical power wires within cable 510; in addition, there could also be monitoring signals generated by the recharging circuitry that could be centrally processed to monitor the state of battery 702. According to still further aspects of the embodiments, battery 702 can be of such size and technology that only trickle charging recharging current is needed to recharge it, and once sufficiently charged (for example, at night time), battery 702 alone can operate motor 114 of the shade. Or, conversely, battery 702 can be of such size that it only provides emergency motor power, e.g., only enough energy to move the shade up and down once or a few times until and unless recharged. According to still further aspects of the embodiments, battery 702 can be used in the embodiments illustrated in FIGS. 5 and 6 as well. According to still further aspects of the embodiments, junction box 120 and first bracket 118 can be manufactured as a unit, or as separate components. According to additional aspects of the embodiments, battery 702 can be non-rechargeable, e.g., a standard alkaline cell/battery pack (among other types), and so can be replaced from time-to-time.

INDUSTRIAL APPLICABILITY

To solve the aforementioned problems, the aspects of the embodiments are directed towards systems, methods, and modes for providing power and data through signals in a concealed manner to motorized shades in a residential home.

The disclosed embodiments provide a system, and method, for interfacing AC power and command/controls signals to a shade 106 according to aspects of the embodiments. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

Alternate Embodiments

Alternate embodiments may be devised without departing from the spirit or the scope of the different aspects of the embodiments.

What is claimed is:

1. A shade motor power bracket assembly for a shade system, comprising:

a shade tube;

a shade motor disposed within the shade tube;

a shade end cap adapted to attach to a first end of the shade tube, the shade end cap comprising a plurality of electrical contact receptacles; and a first bracket adapted to be attached to a mounting surface, the first bracket comprising a plurality of electrical contact pins each adapted to fit within and electrically interface with a respective one of the plurality of electrical contact receptacles;

wherein the shade end cap is adapted to be removably attached to the first bracket and said first bracket is adapted to provide electrical power to the shade motor via at least one electrical contact pin and a respective electrical contact receptacle; and wherein the shade end cap is stationary with respect to the first bracket when the shade tube rotates.

2. The shade motor power bracket assembly according to claim 1, further comprising:

a first cable that includes at least one wire for carrying electrical power to at least one of the plurality of electrical contact pins.

3. The shade motor power bracket assembly according to claim 1, wherein the mounting surface comprises:

a window frame.

4. The shade motor power bracket assembly according to claim 1, wherein the shade end cap comprises a plurality of spring mounted plugs and wherein the first bracket further comprises a plurality of receptacles at locations corresponding to the plurality of spring mounted plugs located on the shade end cap.

5. The shade motor power bracket assembly according to claim 1, wherein the first bracket further comprises:

one or more antennas adapted to receive wirelessly transmitted commands, and transmit the received commands via at least one electrical contact pin and a respective electrical contact receptacle to a transceiver within the shade tube that operates the shade motor.

6. The shade motor power bracket assembly according to claim 1, wherein the first bracket further comprises:

one or more buttons adapted to generate electrical signals adapted to operate the shade motor.

7. The shade motor power bracket assembly according to claim 1, wherein the shade end cap further comprises:

one or more antennas adapted to receive wirelessly transmitted commands, and transmit the received commands to a transceiver that operates the shade motor.

8. The shade motor power bracket assembly according to claim 1, wherein said first bracket is adapted to provide data via at least a second electrical contact pin and a respective second electrical contact receptacle to transmit control commands to the shade motor.

9. The shade motor power bracket assembly according to claim 1, further comprising:

a battery connected to at least one electrical contact pin to provide operating electrical power to the shade motor.

10. The shade motor power bracket assembly according to claim 9, wherein the battery comprises:

a rechargeable battery adapted to accept recharging current from a first cable.

11. The shade motor power bracket assembly according to claim 10, further comprising:

a recharging controller circuit adapted to control charging and discharging of the rechargeable battery.

12. The shade motor power bracket assembly according to claim 1, wherein each of the electrical contact pins comprises a spring.

13. The shade motor power bracket assembly according to claim 1, wherein the mounting surface comprises:

an interior portion of the mounting surface.

14. The shade motor power bracket assembly according to claim 1, wherein the electrical contact pins are adapted to reside in a compressive fitting within the respective electrical contact receptacles.

15. The shade motor power bracket assembly according to claim 1, further comprising:

a junction box adapted to house electrical connectors for the plurality of electrical contact pins.

16. The shade motor power bracket assembly according to claim 15, wherein the junction box is adapted to be recessed in the mounting surface.

17. The shade motor power bracket assembly according to claim 1, wherein the first bracket further comprises:

a first connector connected to electrical power and a second connector connected to the electrical contact pins, wherein the first connector is adapted to be attached to the second connector.

18. The shade motor power bracket assembly according to claim 17, further comprising:

a first cable connected to the first connector to provide the electrical power and a second cable to connect the second connector to the electrical contact pins.

19. The shade motor power bracket assembly according to claim 17, wherein the first and second connectors comprise plug and a receptacle type connector.

20. A shade motor power bracket assembly for a shade system, comprising:

a shade tube;

a shade motor disposed within the shade tube;

a first connector and a second connector;

a shade end cap adapted to attach to a first end of the shade tube, the shade end cap comprising a plurality of electrical contact receptacles; and a first bracket comprising a junction box adapted to be attached to an interior portion of a mounting surface and house the first and second connectors, the first bracket comprising a plurality of electrical contact pins each adapted to fit within and electrically interface with a respective one of the plurality of electrical contact receptacles;

wherein the first connector is connected to electrical power and the second connector is connected to the electrical contact pins, wherein the first connector is adapted to be removably attached to the second connector;

wherein the shade end cap is adapted to be removably attached to the first bracket and said first bracket is adapted to provide electrical power to the shade motor via at least one electrical contact receptacle and a respective electrical contact pin; and wherein the shade end cap is stationary with respect to the first bracket when the shade tube rotates.

21. A shade motor power bracket assembly for a shade system, comprising:

a shade tube;

a shade motor disposed within the shade tube;

a shade end cap adapted to attach to a first end of the shade tube, the shade end cap comprising a plurality of electrical contact pins; and a first bracket adapted to be attached to a mounting surface, the first bracket comprising a plurality of electrical contact receptacles, wherein each electrical contact pin is adapted to fit within and electrically interface with a respective one of the plurality of electrical contact receptacles;

wherein the shade end cap is adapted to be removably attached to the first bracket and said first bracket is adapted to provide electrical power to the shade motor via at least one electrical contact receptacle and a respective electrical contact pin;

wherein the shade end cap is stationary with respect to the first bracket when the shade tube rotates.

* * * * *